US006626803B1

(12) United States Patent
Oglesby et al.

(10) Patent No.: US 6,626,803 B1
(45) Date of Patent: Sep. 30, 2003

(54) TREADMILL CONTROL SYSTEM

(75) Inventors: Gary E. Oglesby, Manhattan, IL (US); Emil S. Golen, Jr., Barrington, IL (US); James B. Fox, Elk Grove Village, IL (US); John Danile, Algonquin, IL (US); Robert D. Kohan, Naperville, IL (US); Christopher E. Clawson, Palatine, IL (US); Kenneth F. Lantz, Poquoson, VA (US); Daniel R. Wille, St. Louis Park, MN (US); Timothy J. Porth, Bloomington, MN (US)

(73) Assignee: Brunswick Corporation, Lake Forest, IL (US)

( * ) Notice: Subject to any disclaimer, the term of this patent is extended or adjusted under 35 U.S.C. 154(b) by 327 days.

(21) Appl. No.: 09/651,249

(22) Filed: Aug. 30, 2000

Related U.S. Application Data

(60) Provisional application No. 60/152,657, filed on Sep. 7, 1999, and provisional application No. 60/159,268, filed on Oct. 13, 1999.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS

| | | | | |
|---|---|---|---|---|
| 4,842,266 A | | 6/1989 | Sweeney, Sr. et al. | |
| 4,860,763 A | | 8/1989 | Schminke | |
| 5,312,310 A | | 5/1994 | Shimizu et al. | |
| 5,318,487 A | | 6/1994 | Golen et al. | |
| 5,512,025 A | * | 4/1996 | Dalebout et al. | 482/54 |
| 5,643,142 A | | 7/1997 | Salerno et al. | |
| 5,690,587 A | | 11/1997 | Gruenangerl | |
| 5,707,319 A | * | 1/1998 | Riley | 482/54 |
| 5,752,897 A | | 5/1998 | Skowronski et al. | |
| 5,803,870 A | * | 9/1998 | Buhler | 482/54 |
| 5,879,270 A | * | 3/1999 | Huish et al. | 482/8 |
| 5,899,834 A | | 5/1999 | Dalebout et al. | |
| 5,921,893 A | | 7/1999 | Hurt | |
| 6,110,076 A | * | 8/2000 | Hurt | 482/54 |
| 6,135,924 A | | 10/2000 | Gibbs et al. | |
| 6,179,754 B1 | | 1/2001 | Wang et al. | 482/54 |
| 6,443,875 B1 | * | 9/2002 | Golen et al. | 482/54 |

FOREIGN PATENT DOCUMENTS

| | | | |
|---|---|---|---|
| GB | 2184361 A | 6/1987 | A63B/23/06 |

* cited by examiner

*Primary Examiner*—Glenn E. Richman
(74) *Attorney, Agent, or Firm*—Michael B. McMurry

(57) ABSTRACT

A microprocessor based exercise treadmill control system is disclosed which includes various features to enhance user operation. These features include programs operative to: permit a set of user controls to cause the treadmill to initially operate at predetermined speeds; permit the user to design custom workouts; permit the user to switch between workout programs while the treadmill is in operation; and perform an automatic cooldown program where the duration of the cooldown is a function of the duration of the workout or the user's heart rate. The features also include a stop program responsive to a detector for automatically stopping the treadmill when a user is no longer on the treadmill and a frame tag module attached to the treadmill frame having a non-volatile memory for storing treadmill configuration, and operational and maintenance data.

28 Claims, 13 Drawing Sheets

TREADMILL CONTROL SYSTEM

This application claims benefit of Prov. Nos. 60/152,657 filed Sep. 7,1999 and 60/159,268 filed Oct. 13,1999.

FIELD OF THE INVENTION

This invention generally relates to exercise equipment and in particular to exercise treadmills having control systems utilizing microprocessors.

BACKGROUND OF THE INVENTION

Exercise treadmills are widely used for performing walking or running aerobic-type exercise while the user remains in a relatively stationary position. In addition exercise treadmills are used for diagnostic and therapeutic purposes. Generally, for all of these purposes, the person on the treadmill performs an exercise routine at a relatively steady and continuous level of physical activity. One example of such a treadmill is provided in U.S. Pat. No. 5,752,897.

Although exercise treadmills that operate using a microprocessor based control system have reached a relatively high state of development, there are a number of significant improvements in the program software that can improve the user's exercise experience.

SUMMARY OF THE INVENTION

It is therefore an object of the invention to provide an exercise treadmill having improved user programs.

A further object of the invention is to provide a treadmill having a control panel that includes a standard set of user controls with a second set of quick start user controls that permits the user to select certain predetermined treadmill operating parameters such as speed to initiate a workout or to change to one of the predetermined speeds during a workout.

Another object of the invention is to provide a treadmill having a control panel that includes user controls that permit the user to program custom user workouts which have certain operating parameters such as speed and inclination where the custom workouts have greater flexibility than the standard workouts normally programed in a treadmill.

An additional object of the invention is to permit the user to switch programs while the treadmill is operating by merely pressing a particular program button without having to stop the treadmill and start a new program.

A further object of the invention is to provide an automatic cooldown feature that automatically begins upon conclusion of the user's workout where the duration of the cooldown is determined by the length of time of the user's workout and where the treadmill includes a heart rate management system, the cooldown can be terminated by the user's heart rate reaching 60% of maximal.

Another object of the invention is to increase the frequency of display information on the user display that is relevant to the manner in which the treadmill is being used and to decrease the frequency of the display information that is not relevant.

A still further object of the invention is to provide a user detect feature that can use a detector such as an IR receiver/transmitter to stop the operation of the treadmill in order to overcome the problem of users leaving treadmills before the end of their programs which can result in treadmills continuing to run for a period of time.

Yet an additional object of the invention is to provide a frame tag module secured to the frame of the treadmill and that includes a nonvolatile electrically erasable programmable memory chip and a real time clock.

It is also an object of the invention to provide a treadmill with a quick start feature.

DETAILED DESCRIPTION OF THE INVENTION

Figure 1:
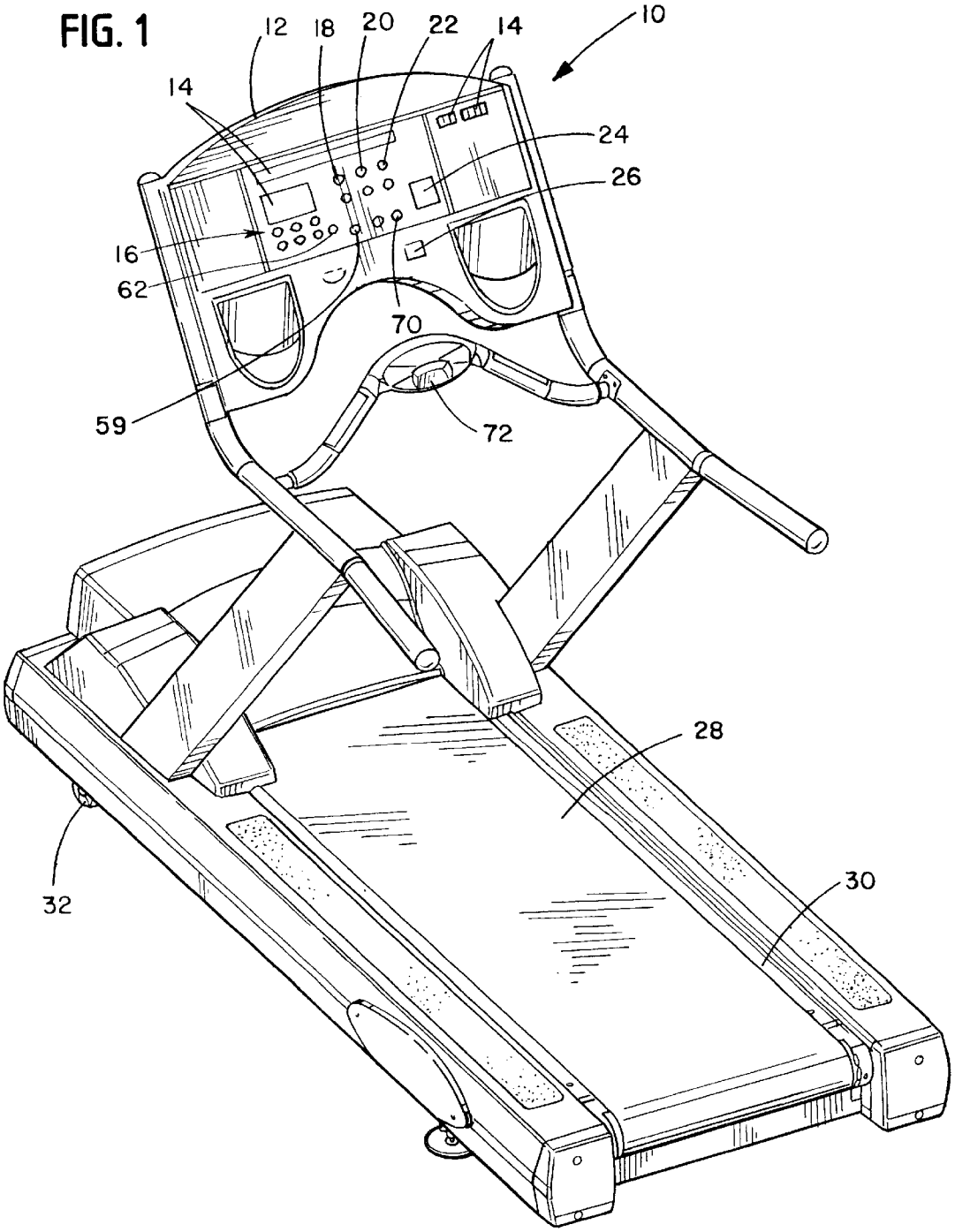
FIG. 1. is a perspective view of an assembled exercise treadmill according to the invention.

FIG. 1 shows the general outer configuration of an exercise treadmill 10, according to the invention. The treadmill includes a control panel 12 having a set of displays 14; a set of workout program control buttons 16; a set of operational controls 18–22 including a pair of time control buttons 18, a pair of incline control buttons 20 and a pair of speed control buttons 22; a numerical keypad 24; and a stop button 26. In addition, the treadmill 10 includes such conventional treadmill elements such as a belt 28, a deck 30 and an inclination mechanism 32 of the type described in U.S. Pat. No. 6,095,951.

Figure 2:
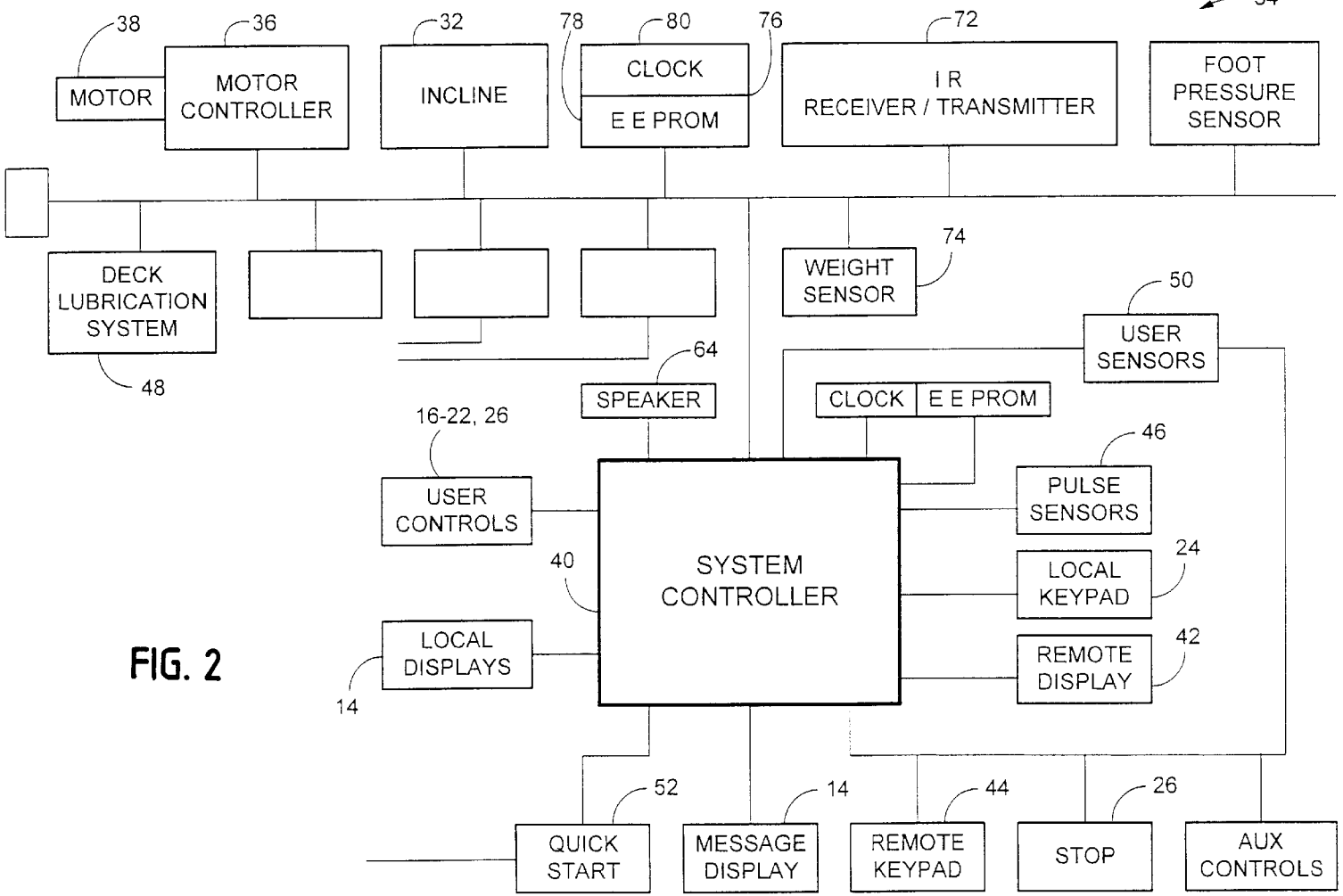
FIG. 2 is a block diagram of the control system for the treadmill of FIG. 1.

FIG. 2 is a representative block diagram of a control system 34 for the treadmill 10. The control system 34 is generally similar to the treadmill control systems of the type shown in FIG. 16 of U.S. Pat. No. 6,095,951 and controls an AC motor 38 having a motor controller 36 to propel the belt 28. The control system 34 uses a microprocessor based system controller 40 to control the control panel displays 14 including a message display 14, the user controls 16–22 and 26 along with the keypad 24, an optional remote display 42 and a remote keypad 44. In addition, the control system 34 serves to control a heart rate monitoring system of the type described in U.S. Pat. No. 5,313,487 utilizing a set of pulse sensors 46 and a deck or belt lubrication system 48 of the type shown in U.S. Pat. No. 5,433,679 along with the inclination mechanism 32. The control system also controls a user detect or sense system 50.

Figure 3:
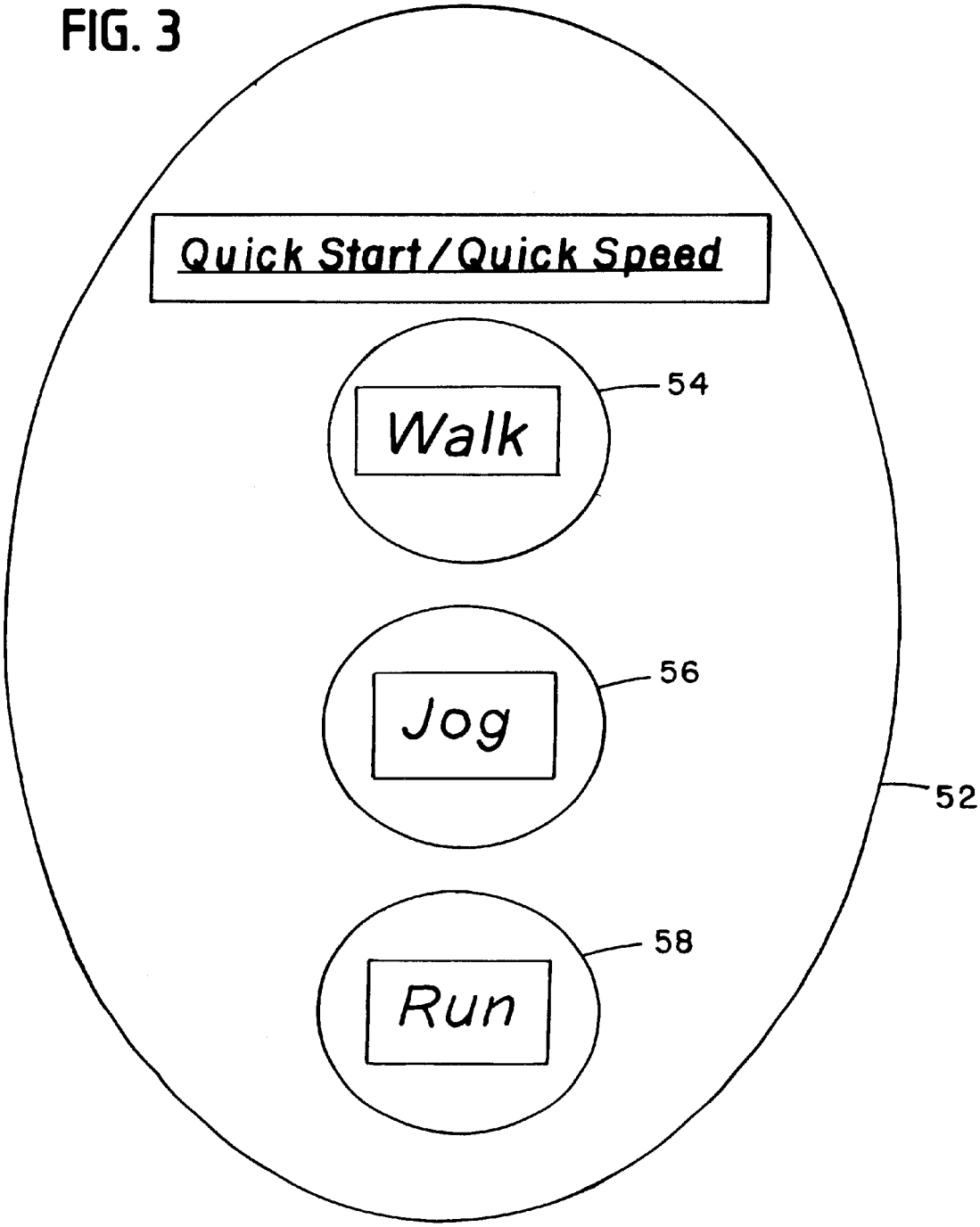
FIG. 3 is a plan view quick start/quick speed control including a set of user switches for a quick start feature for use with the control system of FIG. 1.
Figure 4:
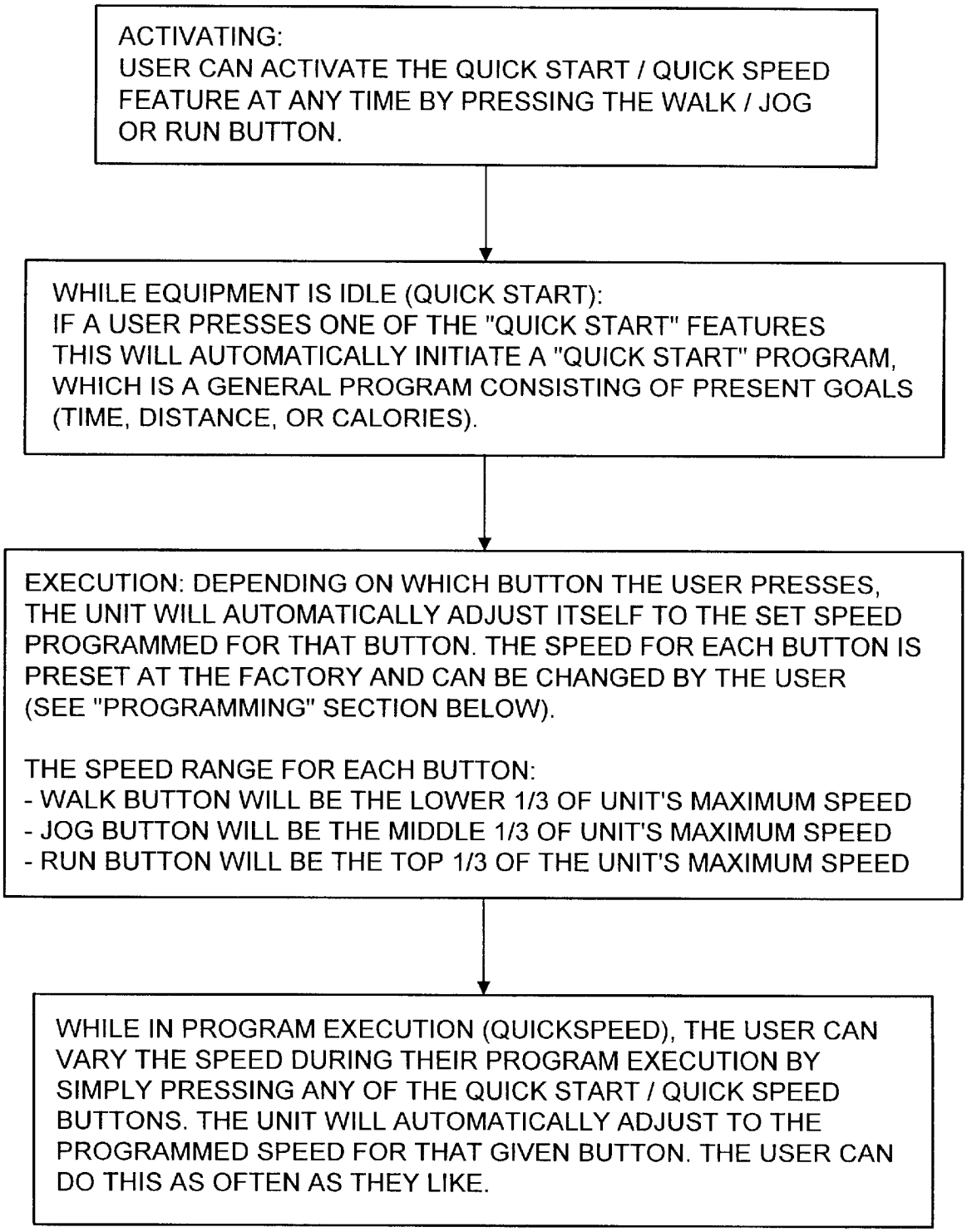
FIGS. 4 and 5 are flow charts illustrating the operation of the quick start/quick speed control of FIG. 3.
Figure 5:
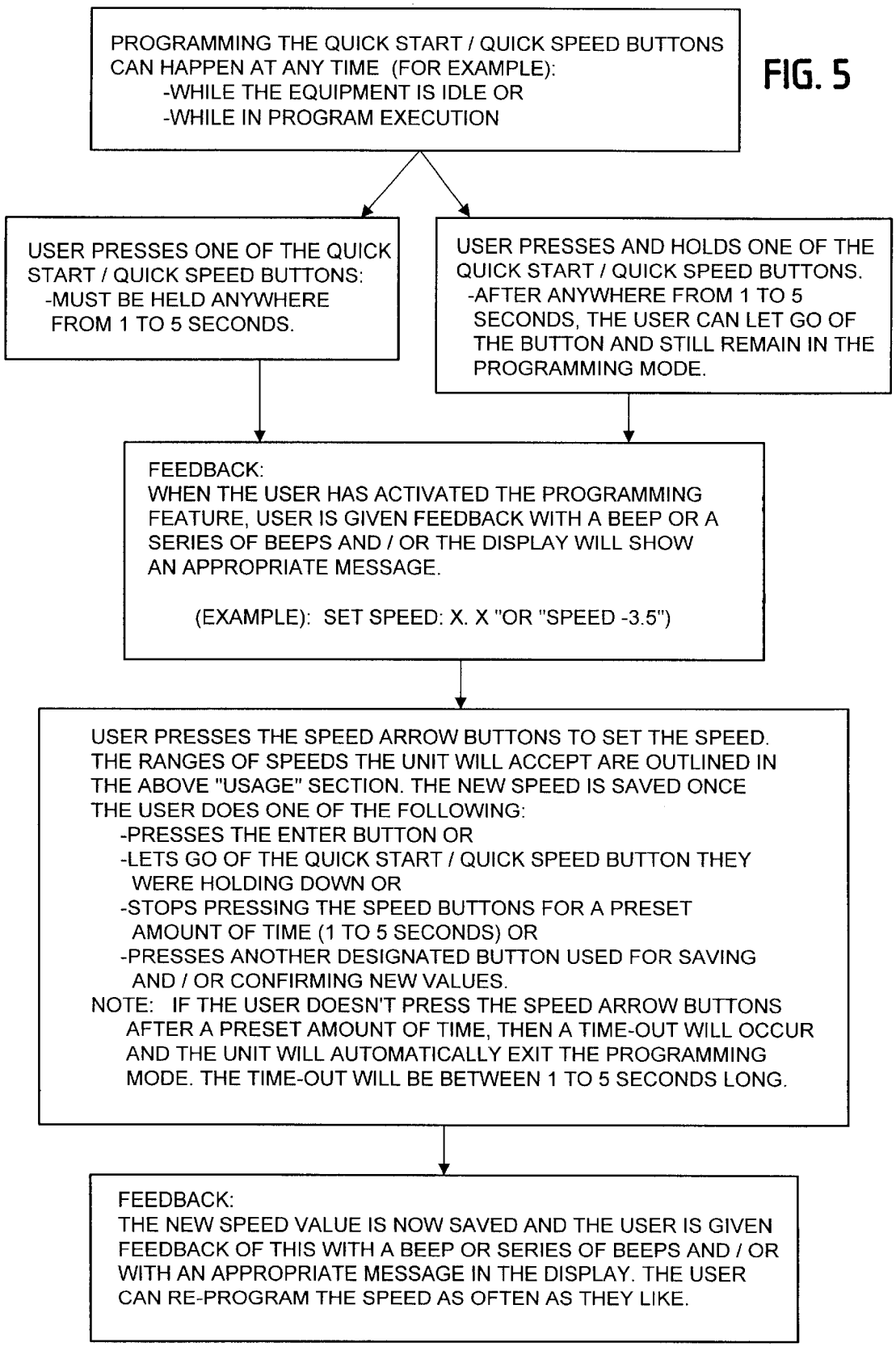

FIGS. 3–5 illustrate a quick start feature that can be implemented in the control system 34. In particular, a quick start keypad 52 can be attached to the control panel 12 or some other part of the treadmill 10. The keypad 52 is provided with a set of three buttons: a walk button 54, a jog button 56 and a run button 58 that can be used by the user to immediately initiate a workout or change a workout having preferably a predetermined speed, for example corresponding to walk, jog or run. The operational controls 18–22 can also be used to set other predetermine workout parameters such as inclination, time, distance or calories. User operation is described in FIG. 4 and operation of the program is described in the flow chart of FIG. 5. Along with a quick start, as indicated in FIGS. 4 and 5, the keypad 52 can be used by the user to immediately implement the predetermined speeds or other workout parameters while another workout is in progress. In addition, it is also possible to use a single quick start button 59 on the control panel 12 in combination with the operational controls 18–22 to initiate the quick start feature.

Figure 6:
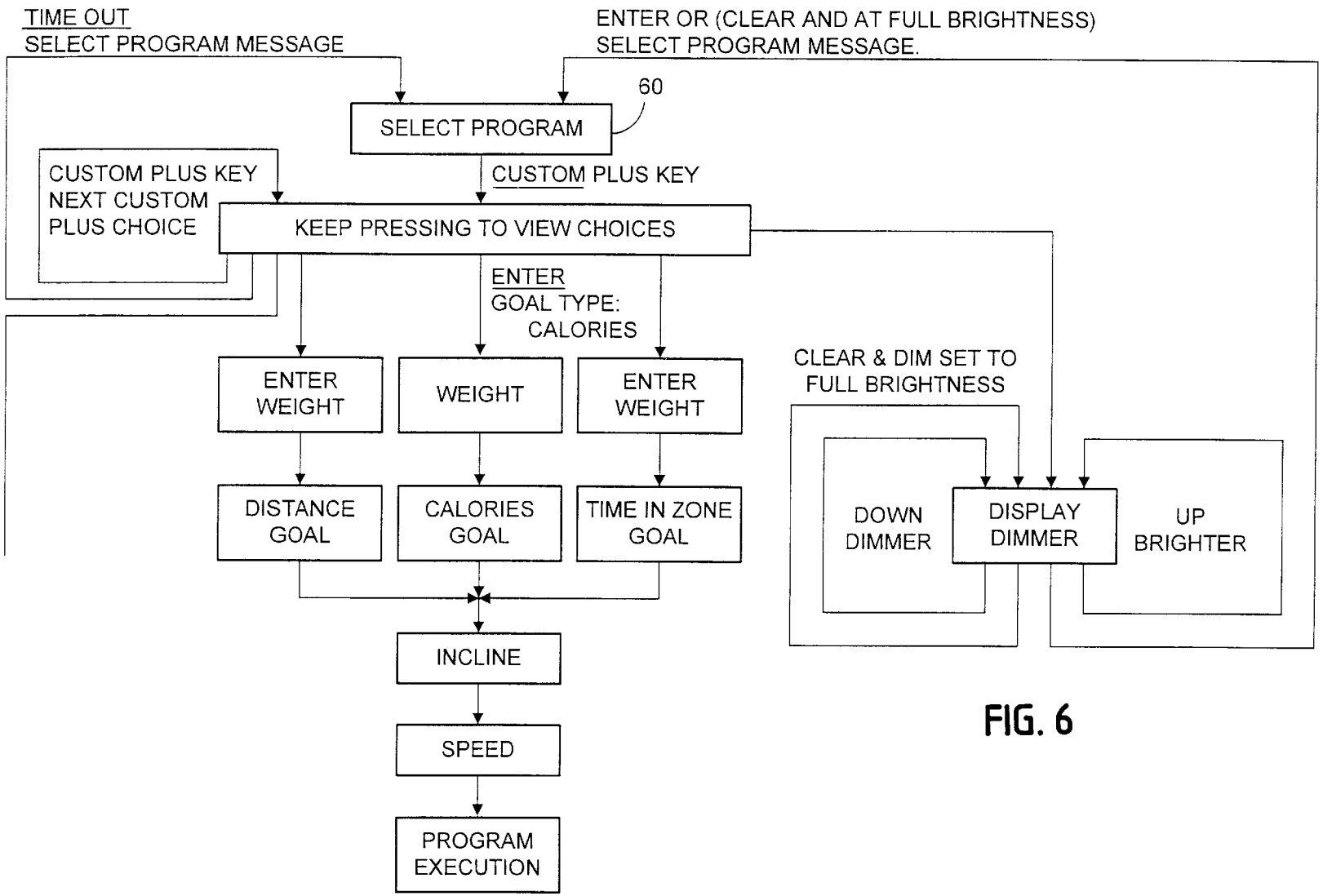
FIGS. 6 and 7 are flow charts illustrating the operation of a custom workout feature for use with the control system of FIG. 2.
Figure 7:
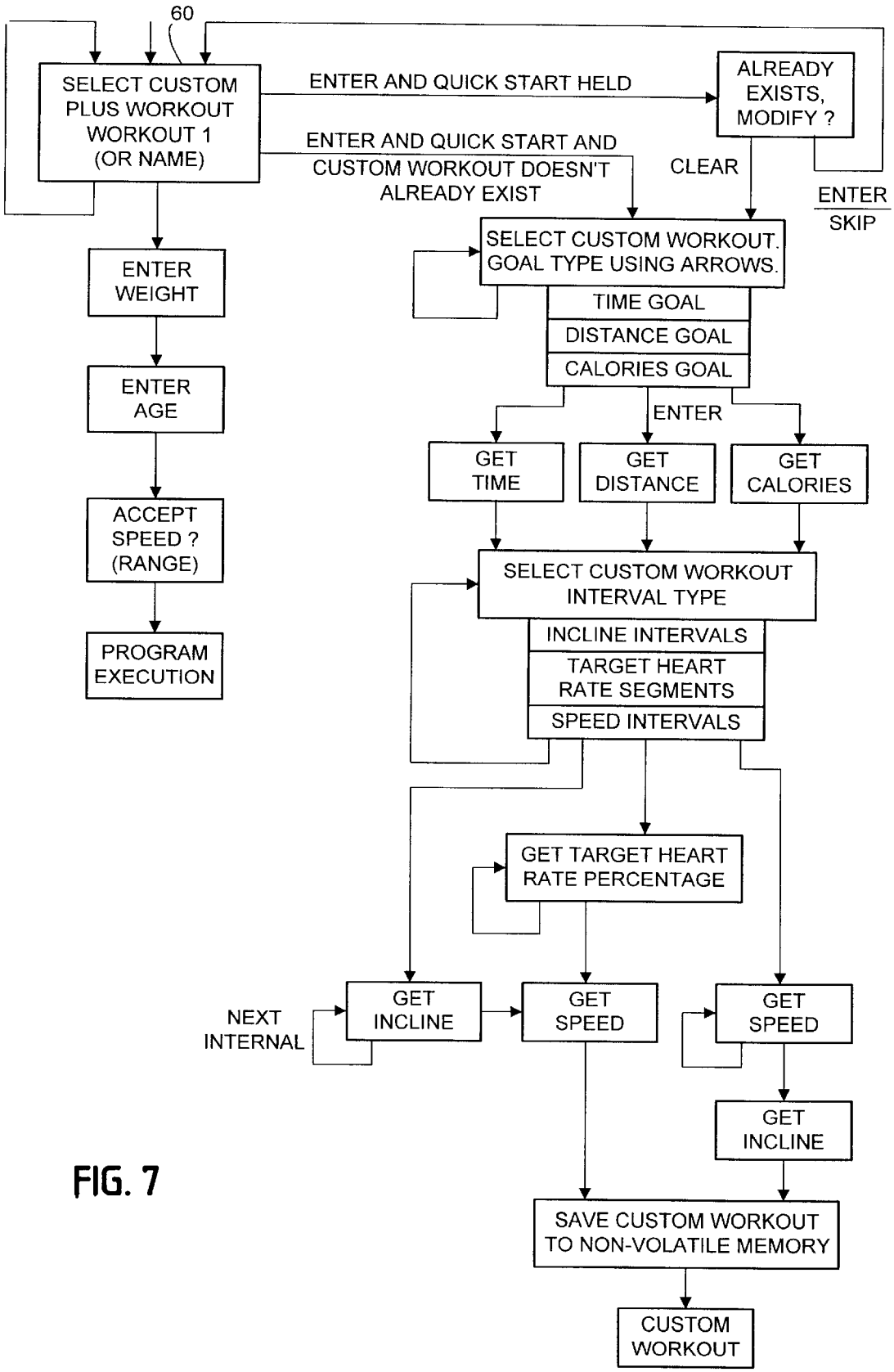

FIGS. 6 and 7 are flow charts describing the logic of a preferred embodiment of a custom workout program that can be implemented in the control system 34. Generally, this feature permits a user or his trainer to use the control keys 18–22, the keypad 24 and the displays 14 to design and program into the control system 34 a custom workout having greater flexibility than the standard workouts normally programed in a treadmill. For example as described in FIGS. 6 and 7, the trainer can define a heart rate workout utilizing the pulse sensors and heart rate management system 46 consisting of a series of segments, up to 30, of a fixed duration in seconds, each segment containing a predetermined target heart rate. As indicated at a block 60 in the flow charts of FIGS. 6 and 7, the user can select the custom program mode by pressing a custom button 62 which is one of the program buttons 16 on the control panel 12. In this case the heart rate management program can be used to control the inclination mechanism 32 of the treadmill 10 thereby regulating the user's heart rate for each interval or segment of the program. Also, custom interval hill workouts can be designed where each segment of the workout represents a different incline of the treadmill 10. Similarly, custom interval speed workouts can be designed by the trainer where each segment of the workout utilizes a different speed. Here, it is desirable to provide the user with an aural warning over a speaker 64 shown in FIG. 2 of speed changes to prevent surprise transitions. Thus, it is possible to provide a wide variety of custom workouts where the user or trainer can define a number of workout parameters such as the initial speed, duration of the workout, distance and calories burned.

Figure 8:
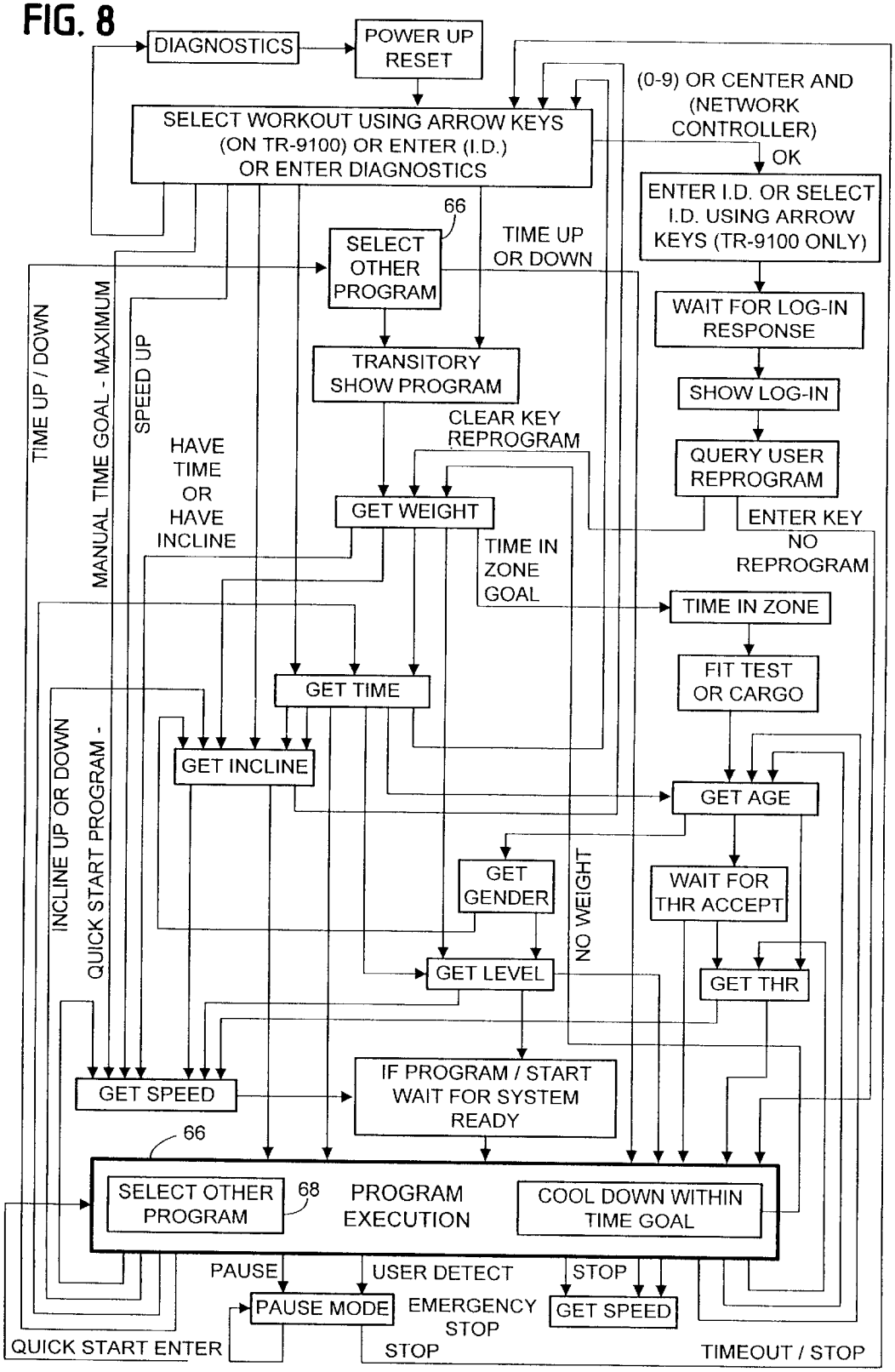
FIG. 8 is a flow chart illustrating the operation of the control system of FIG. 2 to implement a feature whereby the user can select a new workout program while the treadmill of FIG. 1 is operating in another workout program.

FIG. 8 is a flow chart illustrating the operation of the control system 34 to execute workout programs where, as indicated a pair of blocks 66 and 68, the control system 34 also permits the user to switch workout programs on the fly by merely pressing one of the program buttons 16 without having to stop the treadmill 10 and start a new workout program. Specifically, the user can select a new workout program having different parameters including, for example, speed, incline, intervals and heart rate while in the midst of a first workout program.

Figure 9:
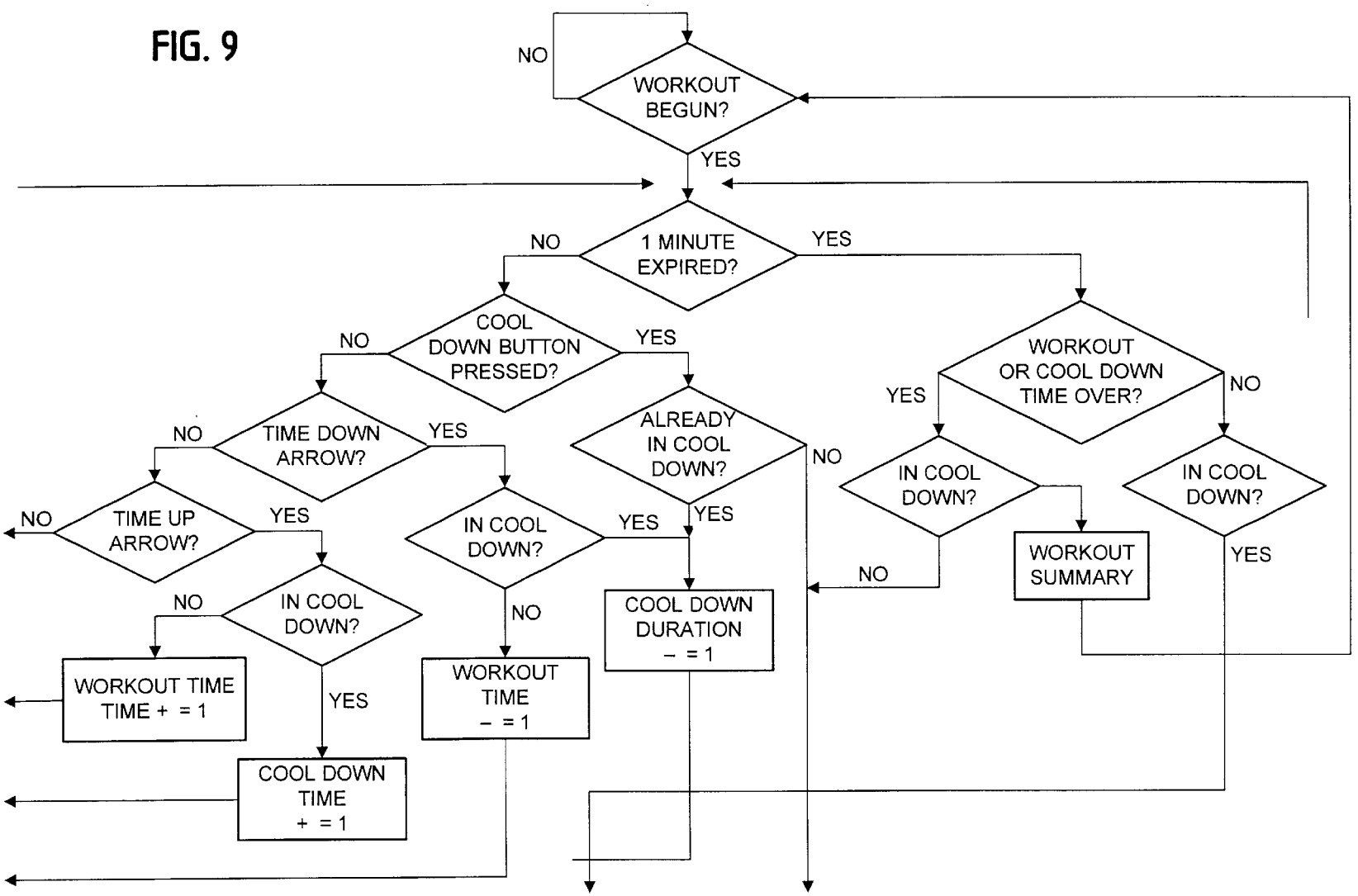
FIGS. 9 and 10A–B are flow charts illustrating the operation of an automatic cooldown feature for use with the control system of FIG. 2.
Figure 10A:
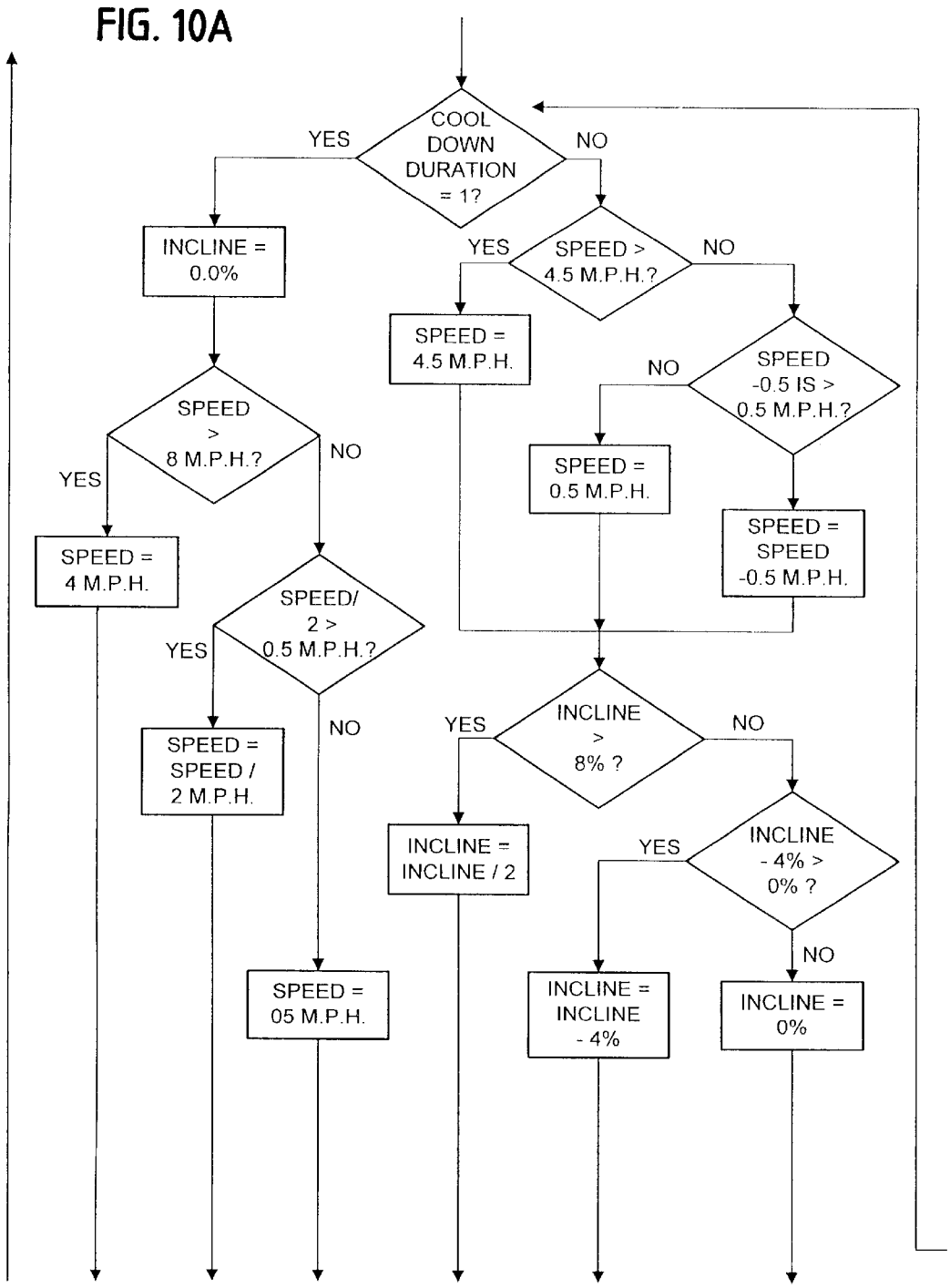
Figure 10B:
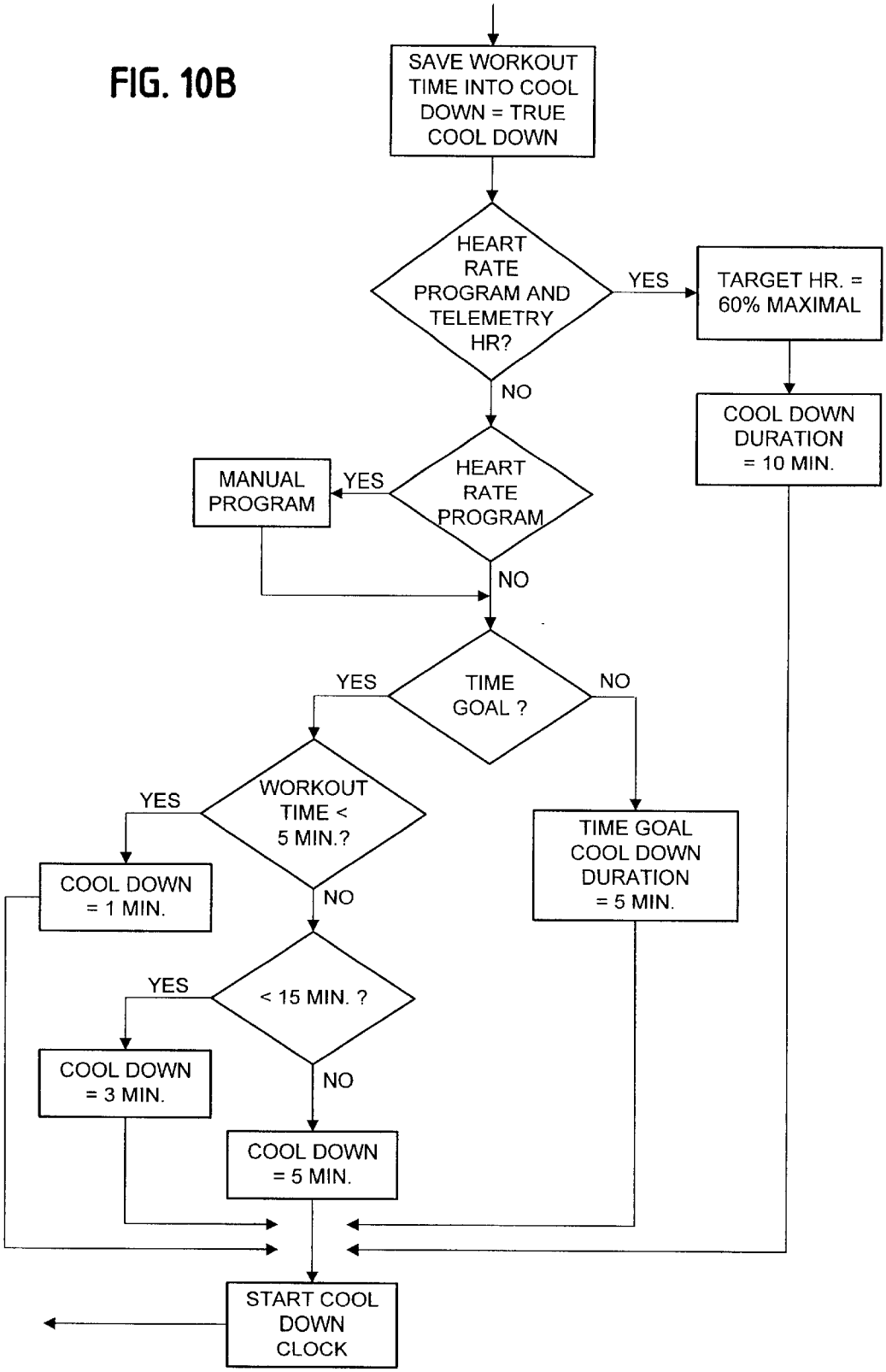

FIGS. 9 and 10A–B show in flow chart form the logic of an automatic cooldown feature that can be implemented in the control system 34. In the protocol described in FIGS. 9 and 10A–B, cooldown will begin automatically upon conclusion of the user's workout. Here, the duration of the cooldown is determined by the length of time of the user's workout or can also be terminated by the user's heart rate reaching 60% of maximal if a heart rate management program of the type identified above is being used. In addition, cooldown can be initiated by the user at any time by pressing a cooldown button 70 located on the control 10 panel 12. In the system described in FIGS. 9 and 10A–B, the cooldown sequence will normally automatically progress each minute except that the user can advance the cooldown by pressing the cooldown button 70 or extend the cooldown by using arrow keys on the keypad 24.

Another feature of the treadmill 10 is the provision in the system controller 34 to only display information on the user displays 14 that is relevant to the manner in which the treadmill 10 is being used. Because the number of discrete displays on the user displays 14 is limited and non-relevant information can be annoying to a user, it is desirable to provide only that information to the user that is most useful for the particular workout that he is performing at the moment. For example, the treadmill 10 having its incline mechanism 32 set at something other than zero will accumulate and can display on one the displays 14 the total vertical distance the user has climbed during the workout. However, if the treadmill 10 is set at zero inclination, the user might become annoyed with a message on the displays 14 always having a zero reading. Thus, in the preferred embodiment of the invention the system controller 40 of the control system of 34 will be programed to only generate a total climb figure on one of the displays 14 at periodic intervals such as 5 minutes. By the same token, generally only runners are interested in their pace such as minutes per mile, so this information will not be displayed by the system controller 40 on the displays 14 for walkers. Also, calories per hour, watts and mets will only be displayed on one of the displays 14 upon a workload change such as a significant speed or incline change so as to eliminate the same message from being displayed on the displays 14 over and over.

Figure 11:
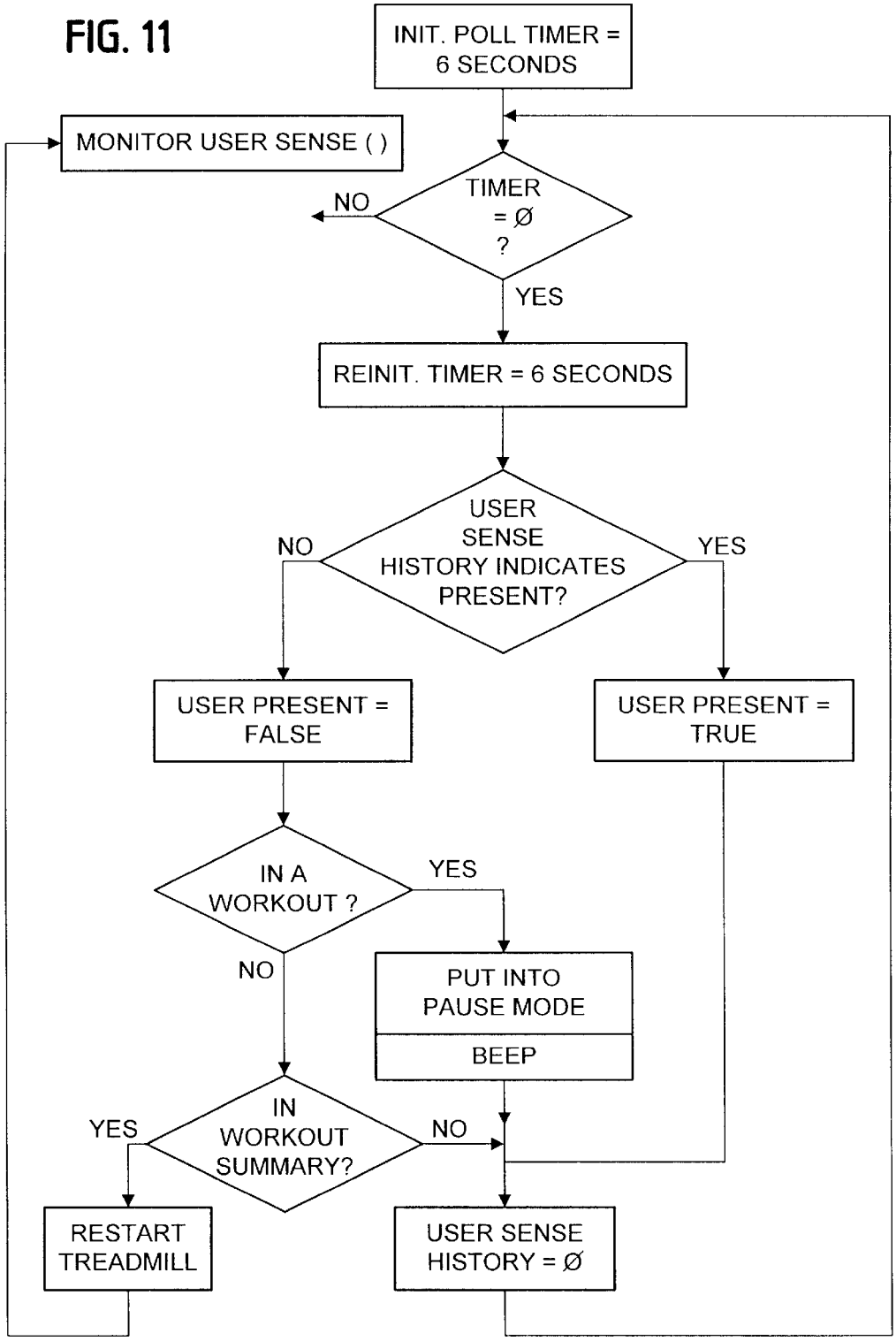
FIGS. 11 and 12 are flow charts of a user detect feature for use with the treadmill with the control system of FIG. 2.
Figure 12:
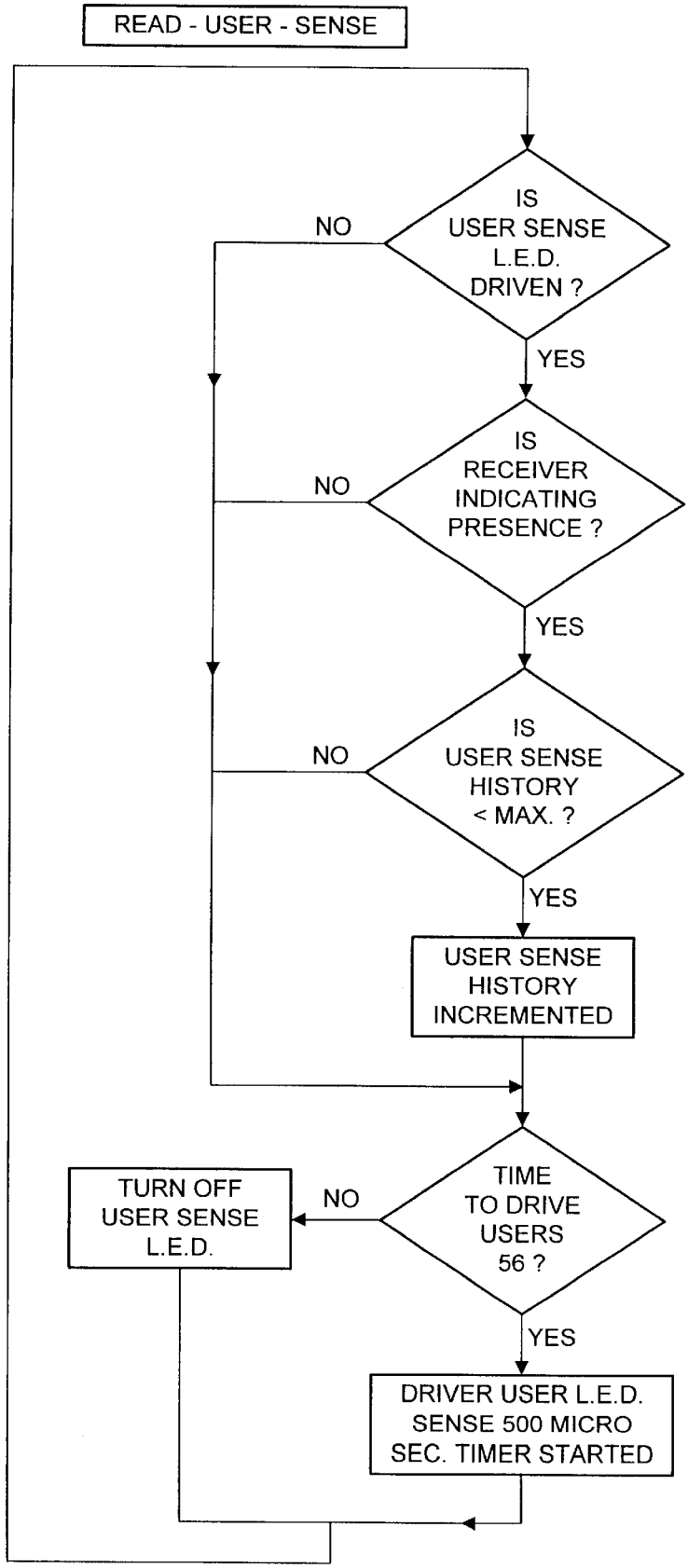

FIGS. 11 and 12 are flow chart illustrating the logic applied by the system controller 40 to implement a user detect feature for use with the treadmill 10. In order to overcome the problem of users leaving treadmills before the end of workout programs which can result in treadmills continuing to run for a period of time, the treadmill 10 can be provided with an auto belt stop mechanism that utilizes a detector such as the infrared receiver/transmitter 72 shown in FIGS. 1 and 2. In the preferred embodiment, a receiver/transmitter 72 transmits an infrared beam which is amplitude modulated at 40 Khz for 500 $\mu$secs every 500 msec. If a user is on the treadmill, some portion of the light will be reflected back to the receiver/transmitter 72 which is sensitive not only to the frequency of the beam but also to the 40 Khz modulation. Thus, the control system 34 can determine if a user is on the treadmill belt 28. When, for example, the user leaves the treadmill 10 with the belt 28 still moving, the system controller 40 will cause the treadmill 10 to wait a predetermined time, such as 6 seconds, and then switch to a pause mode. In the pause mode the belt 28 is stopped and a "pause" message is displayed on one of the displays 14. If there is no user input for another predetermined time to the control system 34, such as 1 minute, the pause mode will time out and the system 34 will reset. Also, the system controller 40 will cause the treadmill inclination mechanism 32 to return the inclination of the treadmill 10 to a zero. It should also be noted that the function of the receiver/transmitter 72 to detect the presence of a user on the belt 28 can be performed by a number of other techniques including a weight sensor 74 as shown in FIG. 2.

Another feature of the treadmill 10 is a frame tag module 76 as shown in FIG. 2 which is preferably secured to one of the side frames of the treadmill 10 and is adapted to communicate with the system controller 40. In the preferred embodiment, the frame tag module 76 includes a nonvolatile electrically erasable programmable memory chip (EEPROM) 78 and a real time clock 80. Included with the EEPROM 78 is a 10 year battery (not shown). Preferably, the clock 80 will be initialized to GMT at the time of manufacture of the treadmill 10 and then set to local time when the treadmill 10 is installed at a customer location and each entry into the EEPROM 78 will be date stamped by the clock 80. In normal operation, each time the treadmill 10 is powered up, the system controller 40 will retrieve treadmill configuration information from the frame tag module 76. Included in this information can be such data items as English or metric units for display on the displays 14, maximum and minimum treadmill belt speeds, language selection as well as accumulated treadmill operational data such as the total time, the total miles, the belt time, the belt miles and the number of program selections. Preferably, when the treadmill 10 is in operation, the system controller 40 will cause data relating to each user workout and operation of the treadmill 10 to be stored in the EEPROM 78 along with all information relating to system errors that might occur. In addition, all information relating to any service procedure is stored in the EEPROM 78. This information stored in the EEPROM 78 including set up, operational and service data can be displayed on the displays 14 by the system controller 40 so that the history of the treadmill 10 can be read by service personnel. One of the advantages of the frame tag module 76 is if any of the major electrical or mechanical components of the treadmill 10 is replaced, the operational history of the treadmill 10 is not lost. For example, if the control panel 12 containing the system controller 40, is replaced the treadmill's history will not be lost. The frame tag module 76 can also be replaced without losing the machine's history. In this case, because when the treadmill 10 is powered up, this information is transmitted from the old frame tag module 76 to the system controller 40, this information can then be transmitted back to the new frame tag module 76 after it has been installed on the treadmill 10 thereby maintaining the treadmill's history with the treadmill 10.

It should be noted that the various features described above have been described in terms of their preferred embodiments in the context of the particular treadmill 10 and control system 34 disclosed herein. The manner in which these features can be implemented will depend upon a number of factors including the nature of the treadmill and control system. With respect to programing, there are many different types of hardware and programing languages and techniques that would be suitable for implementing these features that would be within the scope of this invention.

We claim:

1. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism; and a control panel secured to said frame structure and operatively connected to said control system wherein said control panel includes at least one display and a first set of user controls for controlling the treadmill including said belt speed and said inclination mechanism wherein said control panel includes a second set of user controls for causing said belt to move at a predetermined speed.

2. The exercise treadmill of claim 1 wherein said control system includes programing means for permitting the user to alter said predetermined speeds.

3. The exercise treadmill of claim 2 wherein said programing means responds to a speed control input from said first set of user controls and one of said second set of user controls to set said predetermined belt speed for said one of said second set of user controls.

4. An exercise treadmill, comprising:

a frame structure including two rotatable pulleys, said pulleys being positioned substantially parallel to each other, and a pair of spaced apart longitudinal frame members for providing longitudinal structural support for said frame structure:

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill including said belt speed and said inclination mechanism; and programing means associated with said control system and said control panel for permitting the user to program via said user controls a custom workout having predetermined parameters including belt speed and inclination of said frame structure and wherein said treadmill includes a heart rate management system and wherein said parameters include maintaining the user's heart rate at varying predetermined rates for predetermined time intervals.

5. The exercise treadmill of claim 4 wherein one of said parameters is belt speed intervals wherein said belt speed has predetermined speeds for predetermined time intervals.

6. The exercise treadmill of claim 4 wherein one of said parameters is incline intervals wherein said inclination of said frame structure has predetermined inclinations for predetermined time intervals.

7. The exercise treadmill of claim 4 wherein said heart rate management system utilizes said inclination mechanism to maintain the user's heart rate at said predetermined rates.

8. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill, including said belt speed and said inclination mechanism, to operate a plurality of predetermined workout programs; and program selection means associated with said control system and said control panel for permitting the user to select a first of said workout programs having a set of predetermined parameters including said belt speed and said inclination of said frame structure by said inclination mechanism via said user controls while said treadmill is operating in a second of said workout programs.

9. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill including said belt speed and said inclination mechanism, to permit a user to operate the treadmill for a workout; and cooldown program means associated with said control system for generating a cooldown operation of the treadmill wherein the duration of said cooldown operation is a function of the duration of said workout wherein said duration of said cooldown operation increases with said duration of said workout.

10. The exercise treadmill of claim 9 wherein said cooldown program means begins said cooldown operation immediately at the termination of said workout.

11. The exercise treadmill of claim 10 wherein said user controls includes a cooldown control effective to initiate said cooldown operation prior to the completion of said workout.

12. The exercise treadmill of claim 11 wherein said user controls additionally can be used by the user to increase or decrease the rate of said cooldown operation.

13. The exercise treadmill of claim 9 wherein said cooldown program reduces both the speed of said belt and the inclination of said frame structure.

14. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill including said belt speed and said inclination mechanism, to permit a user to operate the treadmill for a workout;

a heart rate management system operatively connected to said control system and;

cooldown program means associated with said control system for generating a cooldown operation of the treadmill wherein the duration of said cooldown operation is a function of the user's heart rate.

15. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display for displaying a set of workout parameters and a set of user controls for controlling the treadmill including said belt speed and said inclination mechanism, to permit a user to operate the treadmill for a workout; and a display control program means operatively associated with said control system for decreasing the frequency of a first of said workout parameters on said display as a function of said workout.

16. The exercise treadmill of claim 15 wherein said first workout parameter is vertical distance and said function of said workout is the inclination of said frame structure.

17. The exercise treadmill of claim 15 wherein said first workout parameter is the user's pace and said function of said workout is the end of said belt.

18. The exercise treadmill of claim 15 wherein said first workout parameter is the user's energy expenditure and said display control program means displays said energy expenditure when the speed of said belt is increased by a predetermined amount or the inclination of said frame structure is increased by a predetermined amount.

19. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill including said belt speed and said inclination mechanism, to permit a user to operate the treadmill for a workout;

a detector operatively connected to said control system for detecting the presence of a user on said belt; and a stop program operatively associated with said control system and responsive to said detector for stopping the movement of said belt when no user is detected on said belt for a first predetermined amount of time.

20. The exercise treadmill of claim 19 wherein said treadmill includes a pause program, operatively associated with said control system and responsive to one of said user controls, effective to place the treadmill in a pause mode of operation including stopping the movement of said belt and wherein said stop program places said treadmill in said pause mode after said first predetermined amount of time and after a second predetermined amount of time if no user is detected, places the treadmill in a reset mode where the inclination of said frame structure is substantially zero.

21. The exercise treadmill of claim 19 wherein said detector includes an infrared receiver/transmitter.

22. The exercise treadmill of claim 19 wherein said detector includes a weight sensor.

23. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor mid said inclination mechanism;

a control panel secured to said frame structure and operatively connected to said control system wherein said control panel includes at least one display and a sct of user controls for controlling the treadmill including said belt speed and said inclination mechanism, to permit a user to operate the treadmill for a workout; and a frame tag module including a nonvolatile memory and a clock operatively connected to said control system and secured to said frame structure wherein said memory contains treadmill configuration data and treadmill operational data.

24. The exercise treadmill of claim 23 wherein said control system stores data relating to user workouts in said memory.

25. The exercise treadmill of claim 23 wherein said control system obtains said configuration data from said memory when the treadmill is powered up.

26. The exercise treadmill of claim 23 wherein each data entry to said memory is date stamped by said clock.

27. The exercise treadmill of claim 23 wherein said memory includes treadmill service data.

28. The exercise treadmill of claim 27 wherein said service data includes data relating to the replacement of predetermined treadmill components.

* * * * *